United States Patent [19]

Gagne et al.

[11] Patent Number: 4,527,617

[45] Date of Patent: Jul. 9, 1985

[54] REGENERATOR CHECKER PACKING WITH ENHANCED TRANSVERSE FLOW

[75] Inventors: Robert Gagne, New Kensington; Yih-Wan Tsai, Hara Township, Allegheny County, both of Pa.

[73] Assignee: PPG Industries, Inc., Pittsburgh, Pa.

[21] Appl. No.: 538,056

[22] Filed: Sep. 30, 1983

[51] Int. Cl.[3] ..... F28D 17/00

[52] U.S. Cl. ..... 165/9.4; 165/9.1

[58] Field of Search ..... 165/9.1, 9.2, 9.4

[56] References Cited

U.S. PATENT DOCUMENTS

| | | | |
|---|---|---|---|
| 346,782 | 8/1886 | Smith . | |
| 1,381,625 | 6/1921 | Finch . | |
| 1,438,349 | 12/1922 | Whelpley . | |
| 1,574,584 | 2/1926 | Lindner . | |
| 1,745,113 | 1/1930 | Odell . | |
| 1,964,830 | 7/1934 | Pohl et al. . | |
| 1,976,575 | 10/1934 | MacDonald . | |
| 2,303,559 | 12/1942 | Kinney . | |
| 2,432,646 | 12/1947 | Bailey | 165/9.1 |
| 2,467,166 | 4/1949 | Thorpe . | |
| 2,512,555 | 6/1950 | Seaver . | |
| 2,527,429 | 10/1950 | Kennedy . | |
| 2,532,112 | 11/1950 | Mackensen . | |
| 2,667,343 | 1/1954 | Swentzel . | |
| 2,785,212 | 3/1957 | Begley . | |

FOREIGN PATENT DOCUMENTS

| | | | |
|---|---|---|---|
| 2529372 | 1/1977 | Fed. Rep. of Germany | 165/9.1 |
| 11319 | of 1915 | United Kingdom | 165/9.1 |
| 519590 | 2/1975 | U.S.S.R. | 165/9.1 |
| 792068 | 1/1981 | U.S.S.R. | 165/9.2 |

OTHER PUBLICATIONS

G. Scheiblechner–"Veitscher Chimney Type Checker Block Packing Method for Glass Tank Regenerators"–*Glass Technology*, vol. 23, No. 5, Oct. 1982.

*Primary Examiner*—Albert W. Davis, Jr.
*Attorney, Agent, or Firm*—Dennis G. Millman

[57] ABSTRACT

Regenerator packing members are constructed and arranged to form tapered passageways interconnecting regenerator flues to induce transverse flow of gas between flues for increased heat transfer. A preferred embodiment includes parallelepiped bricks arranged in an open basketweave pattern, with spaces between brick ends and side faces defining the tapered passageways.

11 Claims, 11 Drawing Figures

REGENERATOR CHECKER PACKING WITH ENHANCED TRANSVERSE FLOW

BACKGROUND OF THE INVENTION

The invention relates to improving the heat storage capacity of a regenerator, and more particularly to creating transverse flow within a regenerator in which the primary flow is through longitudinally extending, adjacent flues in a regenerator checker packing.

One type of regenerator packing includes heat retaining refractory pieces that are stacked so as to define a checkerwork having a series of substantially parallel flues or open passgeways extending through the checkerwork. During the furnace exhaust phase, hot exhaust gases pass from the furnace through the checkerwork flues where heat is absorbed from the exhaust gases by the packing. Heat retained by the packing is then recovered during the furnace firing phase when combustion air passes in the reverse direction through the flues where it is preheated by the retained heat of the regenerator bricks before passing to the combustion means firing the furnace. The amount of heat recovery possible with a regenerator system depends in large part upon the surface area of refractory material available for heat transfer, but surface area may not always be effectively utilized.

To allow for expansion when heated, generator checkerworks are generally constructed with some open space between refractory pieces, which spaces may or may not close completely when the regenerator is heated. In packing arrangements where these spaces remain, they may provide passageways between flues, but is has been observed that very little, if any, gas flows through these passageways, and therefore the surfaces of these passageways are not effectively utilized for heat transfer.

It is theorized that the temperature of the relatively stagnant air in these transverse passageways tends to equilibrate with the surrounding refractory material, whereby the temperature difference, and thus the heat transfer, is less than if gases from the main stream were actively flowing through the passageways.

Typically, the checker packing is comprised of refractory bricks having rectangular faces, and the transverse passageways comprise spaces between opposed faces of adjacent bricks. Other types of regenerator packing are built from complex, interlocking shapes of refractory, such as chimney blocks of the type manufactured and sold by Veitscher Magnesitwerke, A. G., Vienna, Austria. This type of block is available with an open center portion, so that when stacked, the individual blocks and spaces between blocks define a series of parallel flues. Chimney blocks with transverse passages between the flues are also available, but relatively stagnant conditions would also be expected in these passages.

Various other irregular shapes for checkerwork blocks and bricks have been proposed for increasing turbulence of gases flowing through checker packing, such as those taught in U.S. Pat. No. 2,532,112 to Mackensen, U.S. Pat. No. 1,745,113 to Odell, U.S. Pat. No. 1,574,584 to Lindner and U.S. Pat. No. 2,527,429 to Kennedy. Although acceptable for increasing turbulence in flowing gases, these patents are directed in general to increasing turbulence in gases which flow longitudinally through the regenerator, i.e., in the dominant gas flow direction through the flues.

Although a variety of refractory brick configurations have been proposed for furnaces where combustion occurs within the brick arrangement, such as those taught in U.S. Pat. No. 2,785,212 to Begley and U.S. Pat. No. 1,381,625 to Finch, these bricks are designed primarily for retaining gases within the furnace until complete combustion occurs, rather than for increasing flow of gases therethrough.

It would be advantageous to have a regenerator brick or block arrangement which would increase transverse flow of gases through passages between checker packing flues for improved heat transfer within the regenerator.

SUMMARY OF THE INVENTION

In the present invention, better utilization of heat transfer surface area in regenerator packing is achieved by inducing flow through passageways that extend transversely between longitudinal flue openings through the packing that carry the main gas flow streams. The induced flow through the transverse passageways is caused by providing each passageway with an opening at one end onto a flue that is larger than the opening at the other end onto an adjacent flue. It has been found that an aspiration effect takes place at the mouth of each transverse passageway due to the flow of the main stream of gases across the mouth. When both mouths of a transverse passageway are the same, the aspiration effects offset each other, and no significant flow through the passageway occurs. When one mouth is larger than the other mouth, however, the aspiration is unbalanced, and substantial flow can be induced in the passageway toward the larger mouth.

Two approaches to providing transverse passageways that have a relatively small mouth at one end and a relatively large mouth at the opposite end are contemplated:

(1) a refractory checker piece may be fabricated with one or more of such passageways extending through its body; or (2) refractory checker pieces may be stacked so as to provide such passageways between adjacent pieces.

In the first case, the passageways may be molded into the refractories or cut out of solid refractories. In the second case, an orthogonal stacking pattern may employ refractory pieces having tapered ends, or a nonorthogonal stacking pattern may be employed wherein spaced-apart refractory pieces face one another obliquely to define a tapered passageway. In either case, the refractory pieces may be simple brick types or more complex prefabricated shapes such as the so-called "chimney blocks" which will be described in greater detail hereinafter.

The interior shape of a transverse passageway is not critical to the invention, as long as it extends from a relatively small opening at one end to a relatively large opening at the opposite end, and may include a smooth transition therebetween or a step-wise transition. Thus the passageways may be, for example, wedge-shaped, frustoconical, or counter-bored. For there to be significant aspiration, it should be evident that the interior of a transverse passageway is provided with appropriate volume for the particular flow conditions. The difference between the size of the openings at opposite ends of a passageway will affect the amount of flow that is induced through the passageway and is preferably maximized within practical limits. The large openings should not be so large as to substantially weaken or unduly reduce the mass of the checkerwork. The small openings, on the other hand, should not be so small as to unduly restrict flow therethrough.

In a preferred embodiment, regenerator bricks or blocks are arranged to define transverse tapered passageways interconnecting adjacent primary flues to improve regenerator heat transfer by inducing flow through the passageways. More particularly, parallelepiped shaped refractory bricks are arranged in a pattern, e.g., an open basketweave, such that an angled brick end face of one brick and side face of an adjacent brick define a passageway of tapered configuration.

With the tapered passageways of the present invention incorporated in a checker packing, gases flow through the packing between adjacent flues in a flow path transverse to the primary path of gaseous flow through the flues for increased regenerator heat transfer.

THE DRAWINGS

DETAILED DESCRIPTION OF THE INVENTION

Figure 1:
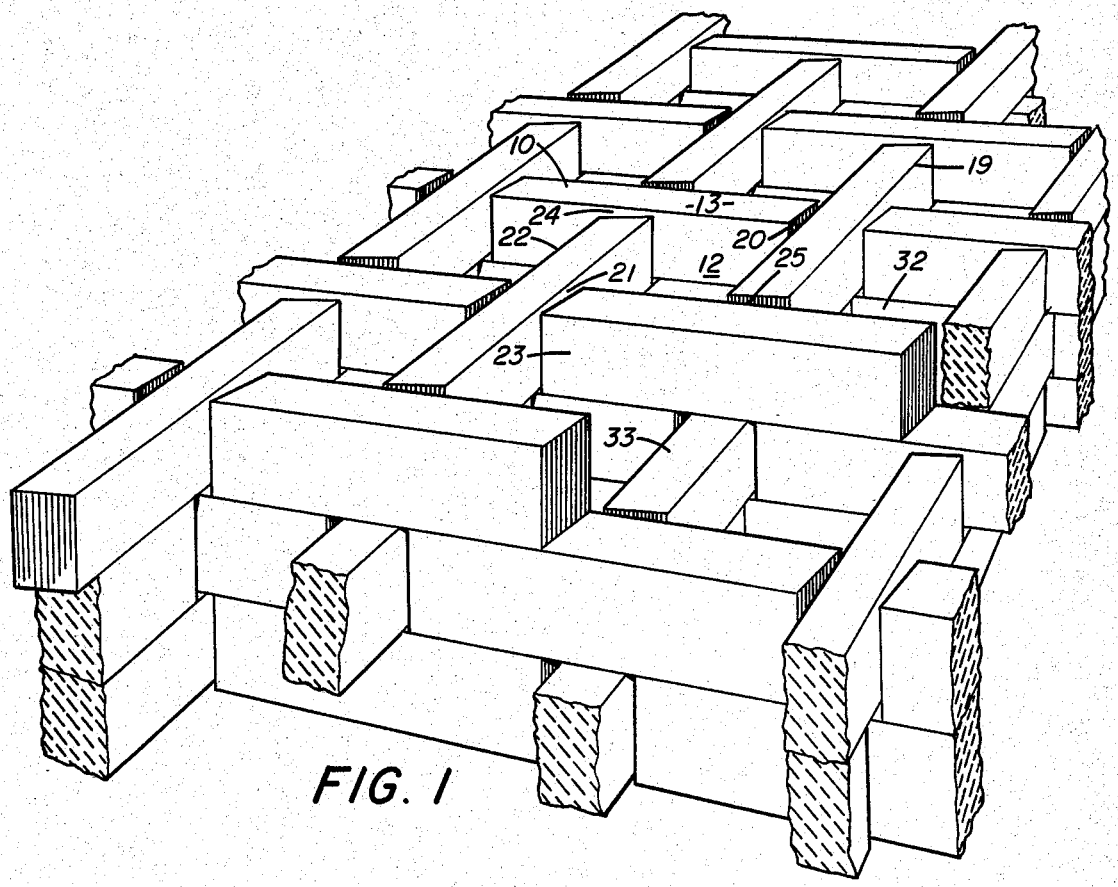
FIG. 1 is a perspective view of a portion of a regenerator checkerwork having an open basketweave pattern and including tapered transverse passageways in accordance with a preferred embodiment of the invention. In the upper left hand corner, a portion of the top course of the checker packing is shown cut away to expose the underlying course.
Figure 2:
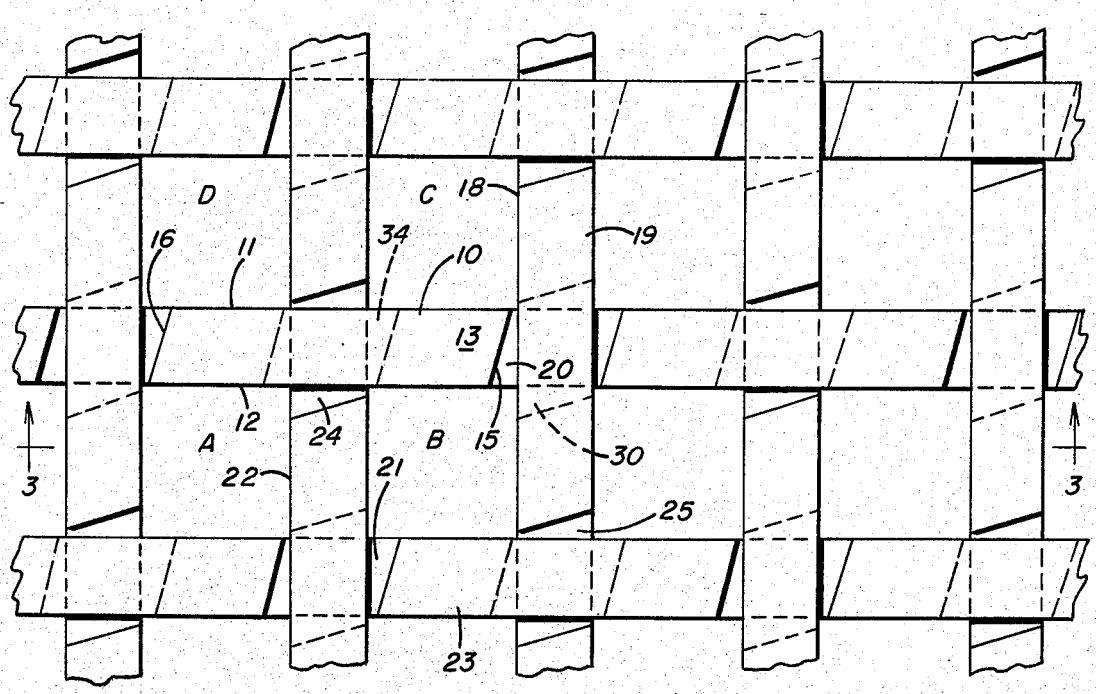
FIG. 2 is a plan view of the checker work of FIG. 1.
Figure 3:
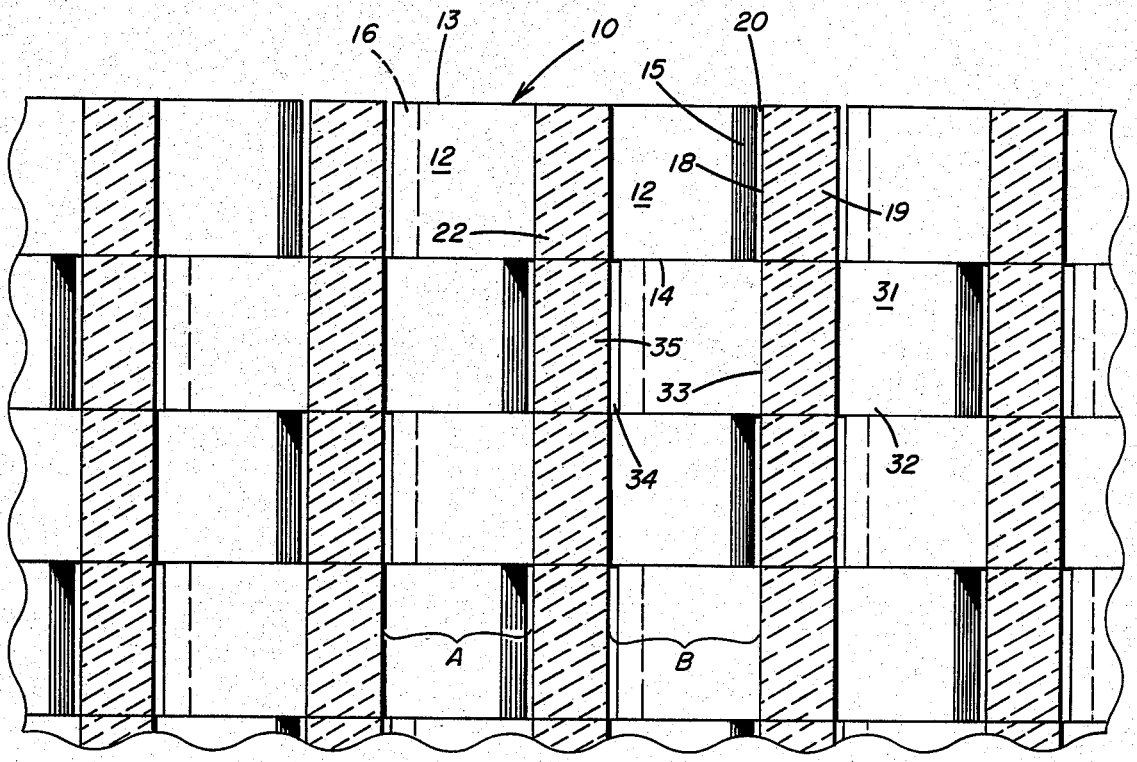
FIG. 3 is a vertical section through the checkerwork of FIG. 1 taken along line 3—3.

In FIGS. 1, 2 and 3 there is shown an example of a preferred embodiment of the present invention incorporated in a regenerator packing arrangement known as the "open basketweave." This arrangement consists of parallelepiped bricks laid in a regular pattern within a given layer or course with the pattern staggered from course to course. Conventionally the bricks for an open basketweave regenerator packing would be rectangular on all six faces. In the embodiment of FIGS. 1, 2 and 3, however, the top and bottom sides of the bricks are parallelograms, or in other words, the ends of the bricks are oblique to the sides. The bricks may be cast with the modified oblique ends, or the ends of conventional rectangular bricks may be cut. Thus, a typical brick 10 may be provided with opposed planar side faces 11 and 12 which are oriented in vertical planes when placed in the regenerator. Top and bottom faces 13 and 14, respectfully, of the typical brick 10 are likewise planar and parallel to each other on opposite sides of the brick and are oriented in horizontal planes when placed in the regenerator packing arrangement shown. End faces 15 and 16 are oblique to the side faces 11 and 12 and may be generally vertical planes. By way of example a brick may have a length of 10 inches (25.4 centimeters), a height of 4.5 inches (11.4 centimeters) and a width of 2.5 inches (6.35 centimeters).

In the open basketweave pattern the end faces of each brick face a center portion of a side face of an adjacent brick within a given course. The top course of bricks is shown cut away in the upper left hand corner of FIG. 1 to expose the underlying course of bricks, and it may be seen that the pattern is repeated in the underlying course but shifted with respect to the upper course. This stacking pattern is repeated a large number of times with alternate courses being identical until the open spaces between the bricks form long vertically extending flues adapted to pass the main stream of gas flowing through the regenerator. The exemplary brick 10, for example, helps define four surrounding flue spaces designated A, B, C and D in FIG. 2. In the prior art the opposed end faces and side wall faces of adjacent bricks would be essentially parallel to each other so that any gap therebetween provides only a straight passageway between flues on opposite sides. In this example of an embodiment of the invention, however, this gap is provided with a wedge shape so as to induce flow of gases from one flue to the other. The wedge shape is provided by the obliqueness of the end faces of the bricks whereby the oblique end face is also oblique to the opposed side face of the adjacent brick. For example, the oblique end face 15 of brick 10 is spaced from side face 18 of brick 19 whereby a wedge shaped passageway 20 is formed therebetween. The passageway 20 provides transverse communication between flue B and flue C and because its opening onto flue B is larger than its opening onto flue C, gas will be induced to flow transversely through the passageway 20 when the main gas stream is passing vertically through flues C and B. The end face 15 and the portion of the adjacent side face 18 directly opposite actively participate in the heat exchange functions of the regenerator due to the induced flow through the passageway 20. Also involved in the improved heat exchange are the small trapezoidal surfaces at the top and bottom of each passageway. Flow in the transverse passageways is from the narrow end to the wide end and, thus, in passageway 20, gases are drawn from flue C and discharged into flue B.

It may be noted that the basketweave pattern provides flue B, for example, with four openings at any given course as shown in FIG. 2. Thus, in addition to passageway 20, another incoming passageway 21 is formed at the opposite corner of flue B by the space between bricks 22 and 23. Additionally, passageways 24 and 25 withdrawing gases from flue B are located at the other diagonally opposed corners of flue B. Preferably each flue has an equal number of ingress and egress passageways to avoid an accumulation of gas pressure in the flue.

Although not essential to the invention, additional improvement may be attained by the preferred arrangement shown in FIGS. 1, 2 and 3, wherein ingress and egress passageways are disposed at alternate corners of each flue so that equilibration of any localized pressure buildup at one of the ingress corners is achieved by flow of gas transversely across the refractory surface between the ingress corner and an adjacent egress corner. This sweep of gas across the intervening refractory face in the direction transverse to the main gas flow through the flue produces turbulence at the refractory surface and thereby improves heat transfer.

A second optional, but preferred, feature of the embodiment of FIGS. 1, 2 and 3 is that ingress and egress passageways are respectively placed at the same corners of a flue in each course of the packing. For example, passageway 30 (formed by the space between the side face 31 of brick 32 and the oblique end face of brick 33) is located in the course below passageway 20, and both passageways are shaped to induce flow into the same corner of flue B. Similarly, passageway 34 (formed by the space between brick 32 and brick 35) is located at the same corner as passageway 24 and both are adapted to withdraw gases from flue B. This pattern repeats itself along the height of each flue whereby ingress passageways are approximately in vertical alignment with each other and egress passageways are also in approximate vertical alignment with each other. The advantage of this pattern is that a cumulative effect on the aspiration of gases through the passageways has been observed. Gas drawn through the passageway into a flue apparently increases the volume flow rate temporarily in the region in which it enters the flue and this localized increased flow rate tends to enhance the aspiration effect in incoming passageways immediately downstream of the first passageway along the main longitudinal flow path of gases through the flue. Conversely, at the regions where gas is withdrawn from a flue the transitory reduction of volume flow rate along the flue reduces the aspiration effect at outgoing passageways immediately downstream thereof, which tends to favor the drawing of more gas through the downstream passageways.

Another advantage of providing transverse passageways with oblique or tapered surfaces is that the surfaces of the passageways are thus more open to exposure to radiant heat transfer from the main flues.

Figure 4:
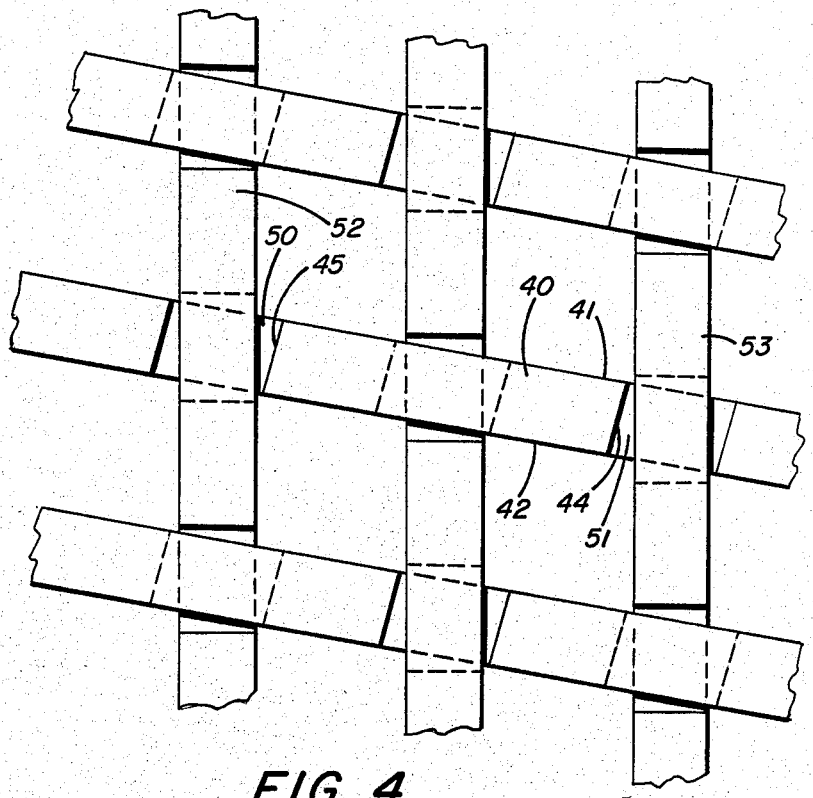
FIG. 4 is a plan view of a variation of the present invention wherein the regenerator packing comprises rectangular bricks in a nonorthogonal stacking pattern.

In FIG. 4 there is shown a variant of a basketweave stacking pattern incorporating the present invention. Rather than employing specially fabricated bricks having oblique end faces as in the embodiment previously described, the bricks in FIG. 4 are rectangular parallelepipeds, that is, ordinary rectangular checker bricks. Thus, a typical brick 40 has side faces 41 and 42 perpendicular to top surface 43 and the bottom surface (not shown), all of which are perpendicular to end faces 44 and 45. The transverse passageways 50 and 51 formed by the end faces 44 and 45 in conjunction with the side faces of the adjacent bricks 52 and 53 have a wedged shape by virtue of the fact that the sides of brick 40 are set at an oblique angle with respect to the sides of bricks 52 and 53. The pattern of FIG. 4 is otherwise the same as in FIGS. 1, 2 and 3.

Figure 5:
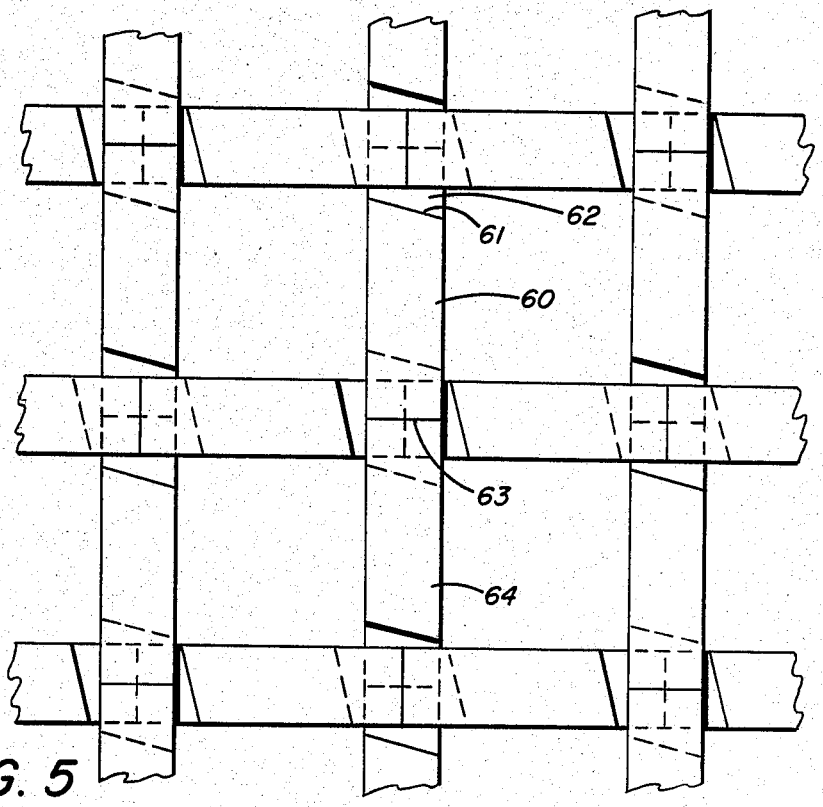
FIG. 5 is a plan view of another type of regenerator packing pattern incorporating the tapered transverse passageways of the present invention.

Another variation may be seen in FIG. 5. This embodiment illustrates an example wherein only one end of a regenerator brick is involved in providing a transverse passageway. In FIG. 5 a typical brick 60 may be provided with one oblique end face 61 so as to provide a wedged shaped transverse passageway 62, but its other end the end face 63 is perpendicular to the adjoining sides. The end face 63 may be abutted to adjacent brick 64 such that no passageway is provided therebetween. The stacking pattern is otherwise similar to the open basketweave pattern described above.

In the embodiments described above, the oblique angle between the transverse passageway sides may vary in accordance with the general principles described, but, by way of example, it has been found satisfactory to provide the wedge shaped passageways with a narrow opening of about $\frac{1}{4}$ inch (6 millimeters) and a wide opening at the other end of about $\frac{3}{4}$ inch (19 millimeters).

Figure 6:
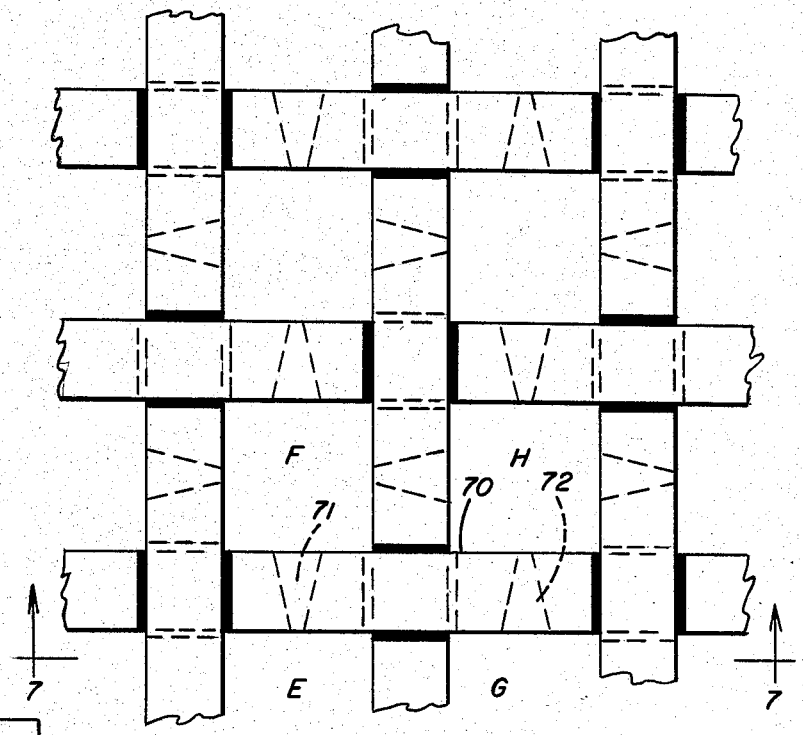
FIG. 6 is a plan view of a regenerator checkerwork comprised of rectangular bricks having tapered transverse orifices in accordance with another embodiment of the invention.
Figure 7:
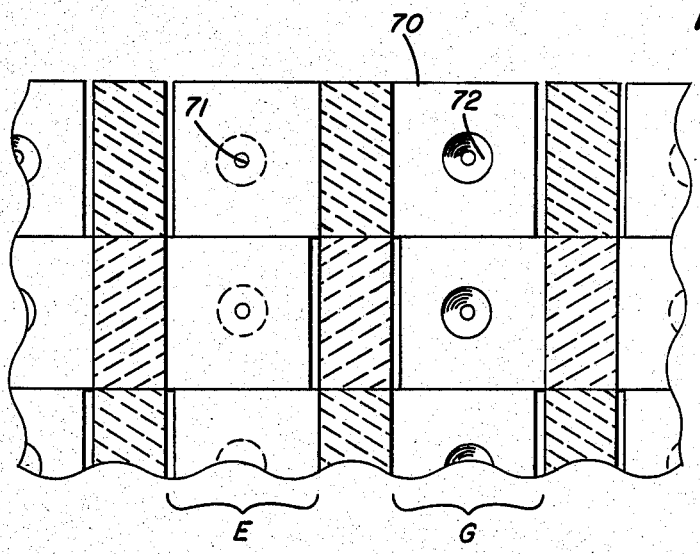
FIG. 7 is a vertical section through the checkerwork of FIG. 6 taken along line 7—7.

The transverse passageways need not be provided by gaps between adjacent bricks but rather may be provided by tapered passageways extending through the bodies of the bricks. Such an embodiment is illustrated in FIGS. 6 and 7. In the plan view of FIG. 6 there can be seen rectangular parallelepiped bricks arranged in a standard open basketweave pattern. Gaps at the ends of the bricks are characteristic of the open basketweave pattern, but for the purposes of this embodiment, a closed basketweave pattern could be used instead, wherein the bricks are in direct contact with each other and no gaps are present after heat-up expansion. Observing a typical brick 70, there is provided a pair of transverse orifices 71 and 72 extending through the brick 70. In this embodiment the orifices 71 and 72 are located near opposite ends of the brick 70 so that orifice 71 is in communication with flues E and F and orifice 72 is in communication with flues G and H, but it should be understood that other arrangements may be provided with more or fewer than two orifices in each brick. Orifice 71 is enlarged at its end opening onto flue F, and therefore transverse flow is induced through the orifice 71 from flue E into flue F. Orifice 72 tapers outwardly toward flue G so as to induce flow from flue H into flue G. As in other embodiments, each flue has associated therewith approximately equal numbers of outgoing and incoming passageways. As can be seen in FIG. 7, it is preferred, although not essential, to align enlarged exit ends of the orifices approximately along the direction of the main gas flow through the flues. As shown, the tapered orifices are approximately centered along the side walls of the flues, but it should be understood that their locations may vary, although the center location is preferred for the purposes of flow strength.

Figure 8:
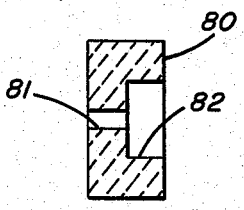
FIG. 8 is a section through an individual regenerator packing brick having a counter-bored transverse orifice in accordance with the invention.

The orifices shown in FIGS. 6 and 7 are smoothly tapered from one end to the other in a frustoconical shape, but the change in orifice diameter may be stepwise as shown in the cross-section of a brick 80 in FIG. 8. The stepwise progression may be preferred in cases where the orifices are provided by boring through previously formed bricks, in which case a relatively small bore 81 and a larger counterbore 82 from the opposite side can conveniently yield the desired variance in orifice diameter from side to side. Instead of the single step shown in FIG. 8, two or more steps may be provided by a corresponding number of boring operations. The orifice passageways shown in FIGS. 6, 7 and 8 are circular in cross-section, but could be of any cross-sectional configuration such as elliptical or any polyhedral shape.

Figure 9:
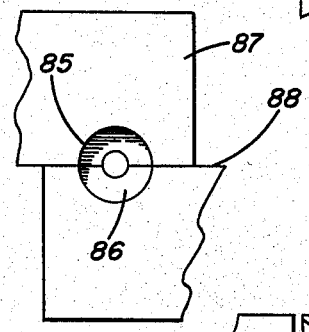
FIG. 9 is a side elevational view of a pair of adjoining refractory bricks that cooperate to form a tapered transverse passageway in accordance with an alternative embodiment of the invention.

Rather than extending through the body of a refractory piece, an orifice-type passageway may be formed along an edge of the refractory piece. For example, in FIG. 9, halves of a passageway 85 and 86 are cut or molded into opposed regions of adjacent bricks 87 and 88 so that when mated they form a full passageway. Alternatively, a passageway formed along an edge of one refractory piece alone may suffice.

Figure 10:
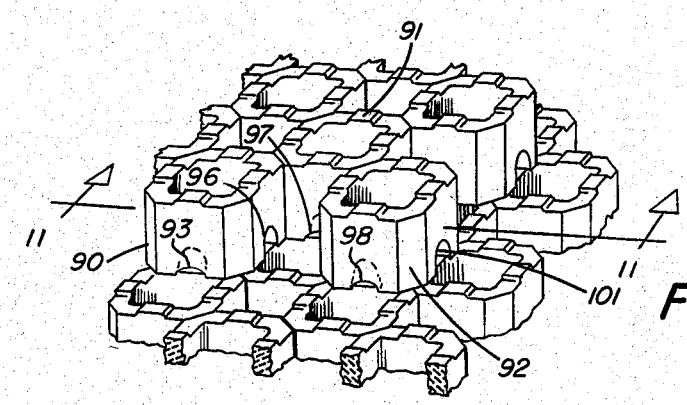
FIG. 10 is a perspective view of a portion of a regenerator packing employing chimney blocks and incorporating transverse tapered openings in accordance with an embodiment of the invention.
Figure 11:
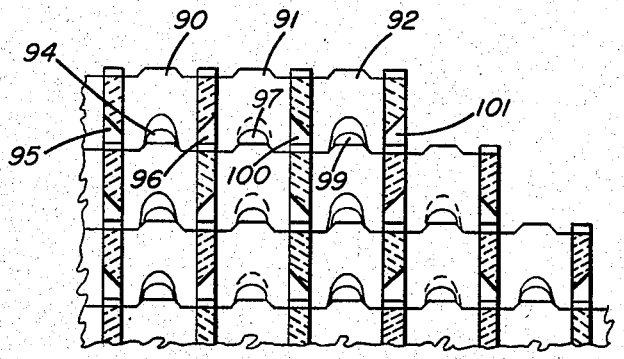
FIG. 11 is a vertical section through the chimney block packing of FIG. 9 taken along line 11—11.

Regenerator refractories more complex in shape than the bricks discussed heretofore, and the present invention is applicable to these complex shapes as well. By way of example, an adaptation of the chimney block type of regenerator refractories to the present invention is shown in FIGS. 10 and 11. As can be seen in the perspective view of FIG. 10, each chimney block comprises a generally cylindrical refractory member having an open center. The blocks are stacked in a staggered arrangement so that the open centers and the spaces between blocks form the vertically extending main flue passages. The blocks may be provided with tabs on their upper edges and indentations on their lower edges that interlock with each other when the blocks are stacked. Chimney blocks are sometimes provided with arched openings along their bottom edges, but these openings are generally of uniform cross-section in the direction transverse to the main gas flow through the flues. In accordance with the present invention these openings may be provided with unequal cross sections from side to side so as to induce transverse flow between adjacent flues. Block 90, for example, may be provided with a pair of inwardly tapering openings 93 and 94 at the bottom edge of opposite walls and with outwardly tapering openings 95 and 96 on the other side walls. An inwardly tapering opening 97 may be seen on block 91. Block 92 is identical to block 90 and is provided with a pair of inwardly tapering openings 98 and 99 on opposite side walls and a pair of outwardly tapering openings 100 and 101 on the other side walls. As shown in FIG. 11, openings tapering in one direction are preferably aligned vertically about one another to take advantage of the cumulative aspiration effect described above. Instead of the arch-type openings shown, the chimney blocks could be provided with tapered orifices extending through their walls in accordance with the present invention.

It should be apparent that tapered orifices and angled spaces between adjacent refractory pieces could be combined in one embodiment. For example, bricks having orifices as shown in FIG. 6 could be stacked obliquely to one another in the manner shown in FIG. 4, or bricks may be provided with both tapered orifices and tapered ends. Other variations and modifications as would be apparent to those skilled in the art are included in the scope of the invention as defined by the claims.

What is claimed is:

1. A regenerator comprising:

a bed of refractory pieces, a plurality of longitudinally extending flues defined by the refractory pieces and adapted to carry the main gas flow stream through the bed, transverse passageways extending between the flues formed by opposed faces of adjacent refractory pieces, characterized by the transverse passageways each having an opening onto a flue at one end that is larger than the opening onto another flue at the other end, whereby gas is induced to flow through the passageways.

2. The regenerator of claim 1 wherein the refractory pieces comprise refractory bricks each having an end face oblique to its side faces.

3. The regenerator of claim 2 wherein the oblique end face is spaced from and faces a side wall portion of an adjacent brick so as to form one of the transverse passageways therebetween.

4. The regenerator of claim 1 wherein the refractory pieces comprise refractory bricks having rectangular faces, and a face of each brick is spaced from and faces a face of an adjacent brick with an oblique angle therebetween.

5. The regenerator of claim 4 wherein an end face of a brick faces a side wall portion of an adjacent brick with an oblique angle therebetween.

6. The regenerator of claim 1 wherein each flue has a plurality of the transverse passageways opening thereonto.

7. The regenerator of claim 6 wherein the openings of a plurality of the transverse passageways are in substantial alignment with one another along the longitudinal extent of the flues.

8. The regenerator of claim 7 wherein a flue has a plurality of longitudinal rows of passageway openings.

9. The regenerator of claim 8 wherein the openings along a longitudinal row are substantially equal in size.

10. The regenerator of claim 9 wherein a flue has associated therewith a plurality of transverse passageways adapted to induce flow into the flue, and a substantially equal number of transverse passageways adapted to induce flow out of the flue.

11. The regenerator of claim 1 wherein a flue has associated therewith a plurality of transverse passageways adapted to induce flow into the flue, and a substantially equal number of transverse passageways adapted to induce flow out of the flue.

* * * * *